United States Patent [19]

Bergland

[11] Patent Number: 4,545,518

[45] Date of Patent: Oct. 8, 1985

[54] WEB APPARATUS WITH VARIABLE REPEAT INTERVAL

[75] Inventor: Paul W. Bergland, Brookfield, Wis.

[73] Assignee: Zerand Corporation, New Berlin, Wis.

[21] Appl. No.: 675,078

[22] Filed: Nov. 26, 1984

[51] Int. Cl.[4] ..... B65H 17/22; B14F 13/04

[52] U.S. Cl. ..... 226/139; 226/143; 101/223; 101/228

[58] Field of Search ..... 226/4, 115, 121, 139, 226/141, 143; 83/250, 263, 403.1, 405, 313; 101/221, 223, 228

[56] References Cited

U.S. PATENT DOCUMENTS

| | | | |
|---|---|---|---|
| 2,758,541 | 8/1956 | Tison | 101/228 |
| 2,845,021 | 7/1958 | Pinckert et al. | 101/228 |
| 3,756,149 | 9/1973 | Bishop | 101/228 |
| 4,153,191 | 5/1979 | Bishop | 226/143 |
| 4,416,200 | 11/1983 | Yon | 226/143 X |

*Primary Examiner*—Leonard D. Christian
*Attorney, Agent, or Firm*—James E. Nilles

[57] ABSTRACT

The delineating cylinder of the web apparatus of this invention has a cutout around one-third of its periphery to be out of contact with the web through an idle phase of its rotational cycle during which a web portion at that cylinder is drawn rearward through an adjustably variable distance. Through the remainder of that cycle that web portion is moved forward in step with delineating cylinder rotation. Upstream and downstream from that cylinder are feed roller pairs, driven through a variable ratio planetray transmission, whereby other portions of the web are moved forward steadily at the rate of one repeat interval length per delineating cycle. Between each pair of feed rollers and the delineating cylinder is a control roller around which there is a loop of web. Each control roller is moved bodily in an orbit whereby its loop is alternately increased and permitted to decrease. The radius of its orbit is adjustably variable for variation of repeat interval length. The orbital cycle of each control roller coincides with the delineating cylinder cycle, but orbital speed of each control roller changes from point to point in its orbit in accordance with the profile of a stationary cam track.

11 Claims, 7 Drawing Figures

WEB APPARATUS WITH VARIABLE REPEAT INTERVAL

FIELD OF THE INVENTION

This invention relates to apparatus that comprises a rotating cylinder whereby uniform impressions are made on a web of indeterminate length at uniform repeat intervals along the web, as in printing, offset lithography and rotary die cutting; and the invention is more particularly concerned with apparatus of that character which provides for steplessly adjustable variation of the length of the repeat interval without the need for changing gear sets to change repeat interval length.

BACKGROUND OF THE PRIOR ART

There are several processes such as printing, offset lithography and rotary die cutting in which a web of indeterminate length, drawn off of a supply roll, is moved lengthwise forward through an impression zone at which it passes through a nip defined by a delineating cylinder that contacts one surface of the web and an opposing cylinder that engages its opposite surface. The delineating cylinder, which carries means for transferring ink or the like to the web, or for cutting or scoring the web, rotates in step with forward movement of the web to make uniform impressions upon it at regular repeat intervals along its length.

In many cases, apparatus for performing these processes should be adjustable for changing the length of the repeat interval, to be capable of running different jobs. An expedient for accomplishing such adjustability is broadly disclosed in each of U.S. Pat. No. 2,758,541 to R. A. Tison (1956), No. 2,845,021 to Pinckert et al (1958), and No. 3,756,149 to T. D. Bishop (1973). In these, the delineating cylinder has a cutout or reduced radius peripheral portion that extends around a part of its circumference, to be out of contact with the web through the fraction of each revolution during which the cutout is juxtaposed to the opposing cylinder. This fraction of a revolution can be considered an idle phase in the rotational cycle of the delineating cylinder. Through an advancing phase which constitutes the remainder of its cycle and during which the delineating cylinder can be in contact with the web, the forward speed of the web is maintained equal to the peripheral speed of that cylinder and the web moves forward though an invariable advancing distance. During the idle phase the web is moved rearward through a decremental distance which is less than the advancing distance. The difference between those distances is the repeat interval length, which can be changed if the decremental distance can be changed.

In the apparatus of the Tison patent, the web is trained in a loop around each of a pair of control rollers, one upstream from the delineating cylinder nip and the other downstream from it. Those control rollers are in turn carried by a frame which reciprocates forwardly and rearwardly to increase and decrease the length of web in each loop. The frame moves forward during the advancing phase of the delineating cylinder cycle, increasing the loop around the downstream control roller and permitting the loop upstream from the nip to decrease in size, thus moving the web through the advancing distance. Rearward movement of the frame during the idle phase effects an opposite change in the sizes of the loops and thus tends to move the web through a decremental distance equal to the advancing distance.

However, during rearward movement of the frame, intermittently driven feed rollers downstream from the frame draw the web forward through a distance equal to the repeat interval length. One of the feed rollers carries a coaxial pinion, to be rotatably driven by endwise movement of a ratchet-toothed rack; and the rack, in turn, has one end connected to a rotating eccentric to be reciprocated lengthwise by rotation of the eccentric, which is synchronized with rotation of the delineating cylinder and reciprocation of the frame. The feed rollers are apparently rotated only during rearward movement of the frame but maintain their grip on the web, without rotation, during forward movement of the frame.

With the apparatus as disclosed by Tison, the web is drawn off of the supply roll intermittently, and therefore the rotational inertia of a heavy supply roll will pose serious problems. A more important deficiency is that the frame that carries the control rollers moves through the same distances and at the same speeds in its forward and its rearward strokes, and therefore the reduced radius portion of the delineating cylinder must extend around at least half of its circumference. This is to say that the delineating cylinder is effectively idle during at least half of each cycle, and output is correspondingly low. Since the frame that carries the control rollers is necessarily rather massive, its forward and rearward strokes must be made at relatively low speed to avoid inertia problems, further contributing to a low rate of production. The manner in which the feed rollers are driven for intermittent rotation also appears to be unsuitable for high speed operation.

The delineating cylinder of the Pinckert et al patent has a radial cutout which extends around only a small fraction of its circumference. During the short idle phase in which that cutout is juxtaposed to the opposing cylinder, the web is drawn rearward by a pair of feed rollers located a small distance upstream from the delineating cylinder. The feed rollers constantly rotate in the direction opposite to that of delineating cylinder rotation and in synchronism with that cylinder, but one of the feed rollers has a reduced radius around a major portion of its circumference, so that it cooperates with the other to grip the web and draw it rearward only during the idle phase of the delineating cylinder cycle. A dancer arrangement upstream from the feed rollers takes up and pays off web as necessary to maintain a steady rate of withdrawal of web from the supply roll.

With this Pinckert et al arrangement the web is, in theory, either being drawn forwardly by the operative peripheral portion of the delineating cylinder or drawn rearwardly by the operative peripheral portion of the one feed roller. However, the web cannot reverse its direction of lengthwise movement instantaneously, and the inevitable decelerations and accelerations must be accommodated by slippages which are indeterminate and variable, so that repeat interval length cannot be accurately maintained. Another and very important deficiency of this prior apparatus is that it has no provision for adjustably varying the decremental distance through which the web is moved rearwardly by the feed rollers, and therefore it does not provide for adjustable variation of repeat interval length.

In the apparatus disclosed by Bishop, the web is moved forward during the advancing phase by its engagement with the delineating cylinder. Accelerations, decelerations and rearward movements of the web during the idle phase are effected by means of a pair of feed rollers located just upstream from the nip that comprises the delineating cylinder, one rotatably driven and the other freely rotatable. During the advancing phase the freely-rotatable feed roller is spaced from the driven one; during the remainder of the cycle the feed roller nip is closed and a pinion coaxially fixed on the shaft of the driven feed roller is rotated by means of an arcuate rack which swings about a fixed axis spaced from the feed roller shafts. The arcuate rack is actuated for swinging back and forth motion, to impart forward and reverse rotations to the driven feed roller, by means of a pair of cams mounted on one end of the delineating cylinder and circumferentially adjustable relative to it, engaged by a cam follower on the rack. The arrangement is such that the delineating cylinder can produce an impression through only a little over half of each cycle, and therefore the rate of production tends to be slow. Accurate circumferential adjustment of the cams on the delineating cylinder, for adjustment of the decremental distance, seems to be difficult, at least in the form of the apparatus that the patent discloses. A further disadvantage for many applications is that during the advancing phase the web is driven only by the delineating cylinder, and therefore the apparatus is suitable only for rotary die cutting operations, for which it is specifically intended. In printing or offset work there would be a possibility of slippage of the delineating cylinder relative to the web.

In view of the deficiencies of the mechanisms disclosed in these prior patents, it is understandable that none of them is known to have had any significant commercialization. Instead, variation in repeat interval length has heretofore been provided for by means of interchangeable parts. A delineating cylinder had to be provided for each of a number of stepwise differing repeat interval lengths, each delineating cylinder having a circumference matched to the repeat interval for which it was intended, and for each such cylinder there had to be a special set of gears by which rotation of the delineating cylinder was synchronized with rotation of the several other cylinders and rollers on the machine.

With interchangeable delineating cylinders and their respective gear sets, a large capital investment was needed to equip a machine for a full range of repeat interval lengths, and some of that investment was always idle. Interchange of parts to convert from one repeat interval length to another was time consuming, and the cost of the skilled labor needed for such interchange was compounded by the loss of production while the interchange was being accomplished. A further important disadvantage was that only stepwise differing repeat interval lengths were available. Where the repeat interval length specified for a particular job fell between those respectively provided for by two sets of interchangeable parts, the job had to be run with the larger repeat interval, leaving the web with blanks between successive impressions along its length. In subsequent cutting of the web to the specified repeat interval lengths, these blank portions had to be discarded, increasing the cost of the job by the cost of the scrapped web material. Such web wastage tended to be especially high with apparatus that made no provision for varying the repeat interval length, as pointed out in the above-discussed Bishop patent, which also mentions that in the production of carton blanks and the like such wastage was often avoided by cutting the web into discrete lengths which were individually fed through the apparatus, "thus introducing an additional machine and an extra handling step."

SUMMARY OF THE INVENTION

The general object of the present invention is to provide apparatus whereby uniform impressions can be made at regular repeat intervals along a web of indeterminate length, which apparatus does not have any of the disadvantages inherent in the above-discussed prior mechanisms but nevertheless provides for stepless adjusting variation of repeat interval length through a substantially wide range.

It is also an object of this invention to provide apparatus of the character described wherein a change in repeat interval length can be effected with a few simple adjustments that can be quickly and easily made, so that both the labor and the down time required for such a change are minimized.

Another and more specific object of the invention is to provide apparatus of the character described wherein the nip comprising the delineating cylinder is not relied upon to impart forward movement to the web so that there can be no slippage between the web and the delineating cylinder, and wherein the web is under positive control all through the rotational cycle of the delineating cylinder, with respect to accelerations and decelerations as well as with respect to steady-state forward and rearward motion.

It is also a specific object of the invention to provide apparatus of the character described wherein web is drawn off of a supply roll at a constant rate, to avoid problems incident to accelerations and decelerations of the rotational speed of a massive supply roll, and wherein the web is fed to a delivery zone at the same rate, to be wound onto a takeup roll or otherwise handled without problems due to fluctuations in the rate of its forward movement at the delivery zone.

Another specific object of the invention is to provide apparatus of the character described wherein the idle phase of the cycle of the delineating cylinder (i.e., the phase in each revolution of that cylinder during which it is out of contact with the web) need be no more than about one-third of that cycle, so that the productive phase is about twice as long as the idle phase to afford a high rate of output.

It is a further object of this invention to provide a web machine such as a press or a rotary die cutter that affords a high rate of production for each of a succession of jobs for which different repeat intervals are specified, the high production rate being achieved both because the machine operates at a good rate when in production and because down time between jobs is reduced by the speed and ease with which the repeat interval can be changed.

Another object of the invention, achieved in a preferred embodiment of it, is to provide apparatus of the above described character wherein the cyclically operating means that imparts alternate forward and rearward movement to web at the delineating cylinder has low inertia, comprising control rollers that are moved in circular orbits of adjustably variable radius.

In general, these and other objects of the invention that will appear as the description proceeds are achieved in apparatus comprising means for guiding a web of indeterminate length, drawn from a supply roll, lengthwise forward along a defined path through an impression zone that has front and rear ends which are spaced apart along said path and to a delivery zone, and a delineating cylinder cooperating with an opposing cylinder to define a nip in said impression zone through which the web passes and at which uniform impressions are produced on the web at uniform repeat intervals along it. The delineating cylinder may be a printing cylinder that carries a plate from which an impression is directly produced on the web, or a blanket cylinder such as is used in offset printing to which ink is transferred from an offset plate and which in turn transfers it to the web, or a die cylinder for cutting or scoring, or any similar cylinder that directly engages the web and produces an impression upon it. The delineating cylinder has a larger-radius peripheral portion and a smaller-radius peripheral portion that is defined by a cutout extending around a part of its circumference, to be out of contact with the web during an idle phase of each cycle of its rotation in which said cutout is juxtaposed to the opposing cylinder and to be capable of producing an impression on the web during an advancing phase which constitutes the remainder of said cycle. The apparatus further comprises drive means for rotating the delineating cylinder at a predetermined peripheral speed of its larger-radius portion.

The apparatus of this invention is characterized by a front pair and a rear pair of feed rollers, each of which pairs defines a nip through which the web passes to be fed forward by the pair, and one feed roller of each said pair is rotatably driven from said drive means at a substantially steady rate such that the length of web fed forward by the pair during each said cycle is equal to the length of a repeat interval. The rear pair is located along said path between the supply roll and the rear end of the impression zone, and the front pair is located along said path between the front end of the impression zone and the delivery zone.

The apparatus is further characterized by front and rear cyclically operating means, each comprising a control roller about which the web is looped, a carrier by which the control roller is carried for cyclical bodily movement transverse to its length whereby the loop of web around the control roller is alternately increased and permitted to decrease, and transmission means drivingly connecting the carrier with said drive means and whereby the carrier is actuated to carry the control roller through a cycle of its bodily movement during each said cycle of the delineating cylinder. The front cyclically operating means is located along said path between the front end of the impression zone and the front pair of feed rollers, for constraining web in the impression zone to move forward at a speed equal to said peripheral speed all during each advancing phase and allowing the web in that zone to move rearward during each idle phase. The rear cyclically operating means is located along said path between the rear pair of feed rollers and the rear end of the impression zone, for allowing web in that zone to move forward all during each advancing phase and constraining web in that zone to move rearward through a predetermined distance during each idle phase.

In a preferred form of the apparatus each cyclically operating means has a fixed axis about which its carrier is rotatable and is further characterized by control roller supporting means mounting its control roller on its carrier eccentrically to its fixed axis to be moved bodily in an orbit about that axis by rotation of the carrier, and means for adjustingly shifting the control roller supporting means radially relative to the carrier, towards and from said fixed axis, to adjustably vary the radius of said orbit and thereby adjustably vary the distance through which web in the impression zone is moved rearward during each idle phase. A variable ratio driving transmission is connected between said drive means and said one feed roller of each pair of feed rollers, for adjustably varying the length of web fed forward by the feed rollers during each cycle of rotation of the delineating cylinder.

In this preferred form of the apparatus the carrier of each cyclically operating means is freely rotatable about its fixed axis and each said transmission means further comprises a driver, a fixed cam means and a drive link. The driver is axially adjacent to the carrier, is confined to rotation coaxially with it and is connected with the drive means to be rotated thereby in unison with rotation of the delineating cylinder. The fixed cam means is axially adjacent to the driver and defines a cam track that is contained in a plane normal to said fixed axis and extends around the same. The drive link has a pivotal connection with the driver to be confined to swinging relative to the driver about a pivot axis which is spaced from and substantially parallel to said fixed axis. A first arm extends outwardly from said pivotal connection and has at its outer end a cam follower engaged with said cam track to be swung about said pivot axis during rotation of the driver by differences in the distance between said fixed axis and successive points along the cam track. A second arm extending outwardly from the pivotal connection is rigid with the first arm to be swingable with it and has at its outer end a connection with the carrier whereby the latter is constrained to rotate through one revolution for each revolution of the driver but is rotationally accelerated and decelerated relative to the driver by swinging of said arms.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

General Arrangement and Operation

Figure 2:
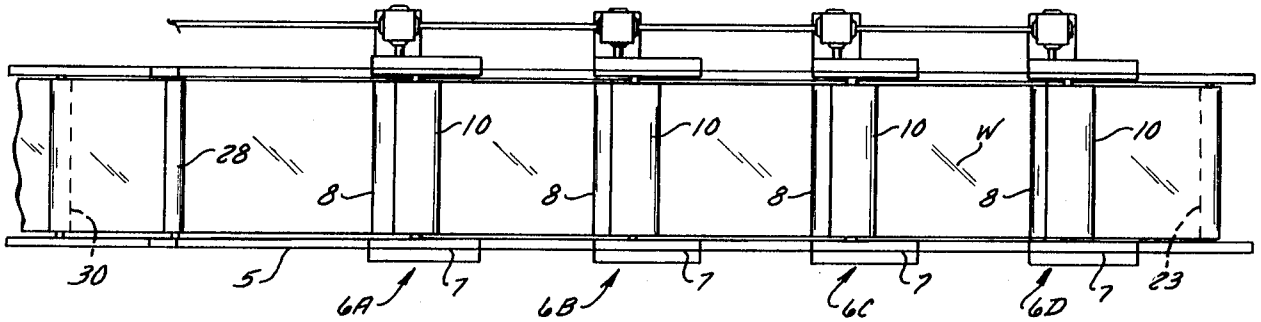
FIG. 2 is a plan view of the machine shown in FIG. 1.

As pointed out hereinabove, the present invention is applicable to practically all operations in which a web of indeterminate length, of paper, paperboard, film, or the like, is moved lengthwise forwardly through a zone in which it is contacted by a rotating delineating cylinder 8 that makes an impression upon the web at uniform-length repeat intervals along it. Merely for purposes of example, the invention is here illustrated as embodied in apparatus that has four delineating cylinders 8 in its impression zone and can perform a four-color process, which can be either an offset process or a process for direct printing from plates on the delineating cylinders.

Thus, the illustrated apparatus comprises a horizontally elongated bed frame 5 upon which are mounted four towers 6A, 6B, 6C, and 6D, one for each of the colors in the process, all essentially identical. At least three of the four towers 6A–6D are adjustable as to their positions along the frame 5, and it will be understood that they are so positioned for any given job that the center-to-center distance between the adjacent towers is equal either to the repeat interval length specified for that job or to a whole-number multiple of that length.

Each tower 6A–6D comprises relatively fixed supporting structure 7 which is adjustably slidable along the bed frame 5 and upon which several rollers and cylinders 8, 9, and 10 are mounted for rotation. Where only one delineating cylinder 8 is needed, as in most single-color printing work and most rotary die cutting operations, the tower structure 7 can of course comprise a fixed part of the bed frame 5. Although other rollers and cylinders may be present on a tower, it will in every case have a delineating cylinder 8 which contacts one side of a web W that moves along the bed frame 5 and an opposing cylinder 9 which contacts the opposite side of the web and which cooperates with the delineating cylinder 8 to define a nip through which the web passes lengthwise. For simplicity, there is here shown only one further cylinder 10, which can be assumed to be a plate cylinder if the machine is intended for offset work or an inking roller if the machine is used for printing directly from an inked plate.

As is conventional, the web W is drawn off of a supply roll 12 mounted on a stand 13 at a rear end of the apparatus. It is moved lengthwise forward through an impression zone 14, in which it passes through the delineating cylinder nip or nips 8, 9 to a delivery zone 15 which is not specifically illustrated because it may be defined by a cutter, a carton forming machine, a takeup roll, a conveyor, or some other mechanism or means, the nature of which will depend upon the type of operation performed in the impression zone 14.

In the apparatus of this invention the delineating cylinder 8 has, in every case, a larger radius peripheral portion 17 and a smaller radius portion which is defined by a peripheral cutout 18 and which extends around a part of the circumference of that cylinder. Thus, as pointed out above, each cycle of rotation of the delineating cylinder 8 comprises an advancing phase during which the larger radius peripheral portion 17 is juxtaposed to the opposing cylinder 9 and an idle phase during which the cutout 18 is juxtaposed to the opposing cylinder and the delineating cylinder is out of contact with the web.

The delineating means (not shown) on the delineating cylinder —whether a plate, offset blanket, or rotary die—occupies the larger radius portion 17; and the means for detachably locking that delineating means to the delineating cylinder can be accommodated in any suitable manner in the cutout 18.

Figure 1:
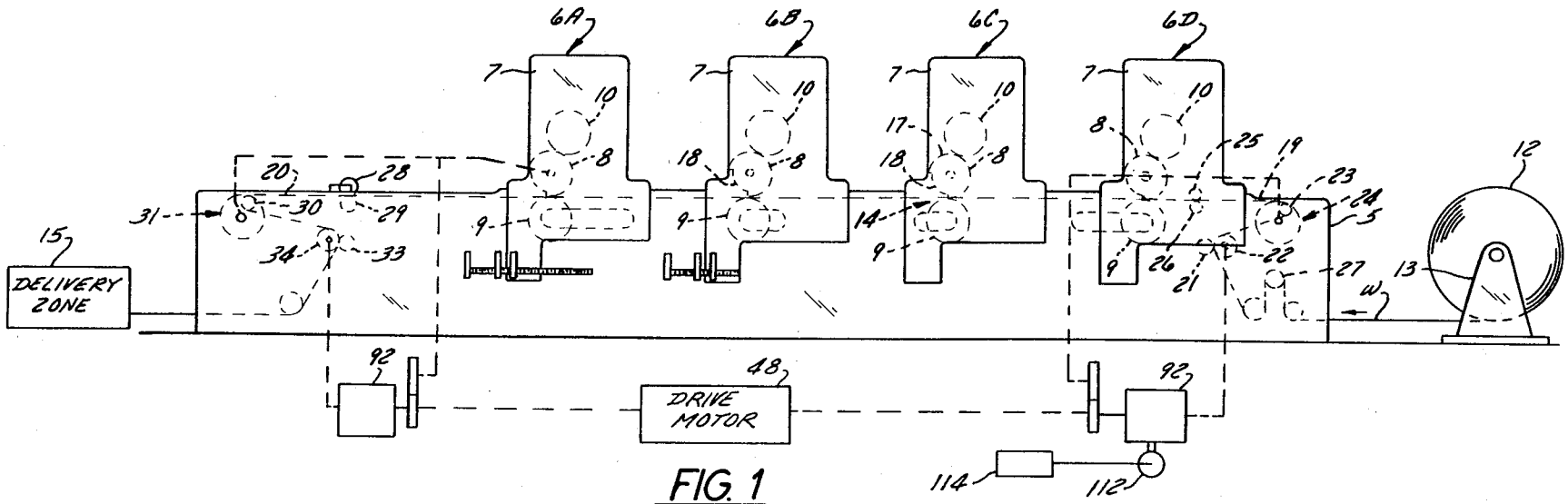
FIG. 1 is a simplified and somewhat schematic view in side elevation of apparatus embodying the principles of this invention, illustrated as a machine for a four-color process.

It will be apparent that during each revolution of the delineating cylinder 8, the maximum length of the impression that it can make on the web is equal to the circumferential distance around its larger radius peripheral portion 17. As the description proceeds, it will be aparent that it is possible to select and use that maximum length or any desired shorter impression length as the repeat interval length. Where the required repeat interval length is short enough, two or more successive impressions can be made in each cycle of the delineating cylinder; and with this possibility in mind it will be apparent that the cutout 18 should have the shortest possible circumferential extension, one-third of the circumference being a preferred value. It is also possible to select a repeat interval length shorter than the length of the impression made by the delineating cylinder, to provide for a staggered pattern of impressions along the web, as is often desirable in rotary die carton blanking. As can be seen from FIG. 1, where the web W is acted upon by plural delineating cylinders 8, the several delineating cylinders rotate in phase with one another, that is, they are in like positions of rotation at all times.

In accordance with the principles of this invention, web is drawn off of the supply roll 12 at a steady feed rate, equal to the length of one repeat interval per revolution of the delineating cylinder 8, and it can be moved into the delivery zone 15 at that same feed rate. However, the stretch of web in the impression zone 14, which is in effect isolated from upstream and downstream portions of the web by loops 19 and 20 as explained hereinafter, is moved forwardly all during the advancing phase of a delineating cylinder cycle but is moved rearward through a decrement distance during the idle phase. The speed of forward movement of that web stretch during the advancing phase is an impression speed which is faster than the feed rate and is equal to the substantially constant peripheral speed of the larger radius portion 17 of the delineating cylinder. During the idle phase, the impression zone web stretch first continues its forward movement while being decelerated to a stop, is then moved rearward, and is thereafter forwardly accelerated back to impression speed. The distance through which the web moves forward during the advancing phase is of course a constant and does not change with changes in repeat interval length. The repeat interval length is changed by making an adjustment that changes the decrement distance through which the web moves rearward during the idle phase, as explained hereinafter.

Web W drawn off of the supply roll 12 first passes in its lengthwise forward movement around a generally conventional dancer 27 by which tension is maintained at the supply roll, then moves through the nip of a rear or upstream pair of feed rollers 21, 22 which draw web off of the supply roll at the feed rate, and then passes in the loop 19 around a bodily movable control roller 23 that comprises part of a rear or upstream cyclically operating means designated generally by 24. Preferably the web next passes between a pair of web tensioning rollers 25, 26, located at or near the rear end of the impression zone 14; and it then moves through the delineating cylinder nip or nips 8, 9 in the impression zone. At or near the front or downstream end of the impression zone there is preferably another pair of web tensioning rollers 28, 29; and after passing between them the web passes in the loop 20 around a bodily movable control roller 30 that comprises part of a front or downstream cyclically operating means designated generally by 31. From this the web moves through the nip of a front or downstream pair of feed rollers 33, 34, which rotate in unison with the rear feed rollers 21, 22. If the web is delivered to a takeup roll (not shown) in the delivery zone 15, it may pass around another dancer (not shown, but which can be substantially identical to the dancer 27) in progressing from the front feed rollers 33, 34 to that takeup roll.

It will be observed that the mechanism along that part of the web path that is between the impression zone 14 and the delivery zone 15 is essentially a mirror image of the mechanism between the supply roll 12 and the impression zone 14.

Each of the cyclically operating means 24 and 31 carries its control roller 23, 30, respectively, in bodily movement transverse to its length through a cycle whereby the loop 19, 20 of web around the control roller is alternately caused to increase and permitted to decrease. The two cyclically operating means are so coordinated with one another and synchronized with the delineating cylinder 8 that the two control rollers 23 and 30 are carried in unison bodily movement and make a cycle of such movement during each rotational cycle of the delineating cylinder 8. Thus each control roller 23, 30 is always moving in the same direction as the other, and therefore the loop of web 19, 20 around one control roller 23, 30 always increases while the loop 20, 19 around the other control roller 30, 23 decreases.

During the idle phase of the delineating cylinder cycle, the rear or upstream control roller 23 moves rearwardly away from the impression zone 14 to increase the loop 19 of web around it, and does so fast enough to compel the stretch of web in the impression zone to move rearwardly. Simultaneous bodily movement of the downstream control roller 30 in the same direction and at the same speed permits the loop 20 of web around it to decrease, thus permitting such rearward movement of the web stretch in the impression zone. During the advancing phase of the delineating cylinder cycle, the two control rollers 23 and 30 move bodily forward in unison, so that the downstream loop 20 is increased while the upstream loop 19 is permitted to decrease, and the web stretch in the impression zone therefore moves forward at the impression speed, which is faster than the feed rate at which the feed rollers 21, 22 and 33, 34 are steadily advancing it. Accelerations and decelerations of the web stretch in the impression zone, which occur during the idle phase of the delineating cylinder cycle, are of course similarly controlled by the unison bodily movements of the control rollers 23, 30.

The cyclical bodily movement of each control roller 23, 30 can be either a reciprocation along a straight or arcuate path or an orbital movement. For adjustability of repeat interval length, the range of movement of each control roller in its cyclical path must be adjustably variable. Thus, if the control rollers 23, 30 are reciprocated, the distance through which each is carried in its back-and-forth strokes must be adjustably variable; and if they are moved orbitally, the radius of the orbit of each must be adjustably variable. Since the control rollers 23, 30 must move in unison, any adjustment of the range of movement of one requires a like adjustment of the range of movement of the other. In addition, any adjustment for change in repeat interval length requires an adjustment in the ratio between rotational speed of the delineating cylinder 8 (which can be regarded as a constant) and rotational speed of the feed rollers 21, 22 and 33, 34, which must always rotate at a peripheral speed equal to the repeat interval length per revolution of the delineating cylinder.

The provisions for these two types of adjustments will now be explained, starting with that for the control rollers 23, 30.

Cyclically Operating Means

A cyclically operating means generally suitable for effecting reciprocating bodily motion of each control roller is disclosed in U.S. Pat. No. 3,702,673, to P. Zernof et al, which has a common assignee herewith. That mechanism comprises a timing and actuating cam constrained to rotate in unison with the delineating cylinder and a medially pivoted bell crank having at one of its ends a cam follower which engages said cam to effect swinging of the bell crank as the cam rotates and having at its other end an adjustable linkage connection with a pendulum-like carrier that supports the control roller. Those skilled in the art will readily perceive the minor modifications that have to be made in this prior structure to adapt it to the present invention, and particularly the modifications needed in the profile of the timing and actuating cam to cause it to effect rearward movement of the stretch of web in the impression zone.

Figure 3:
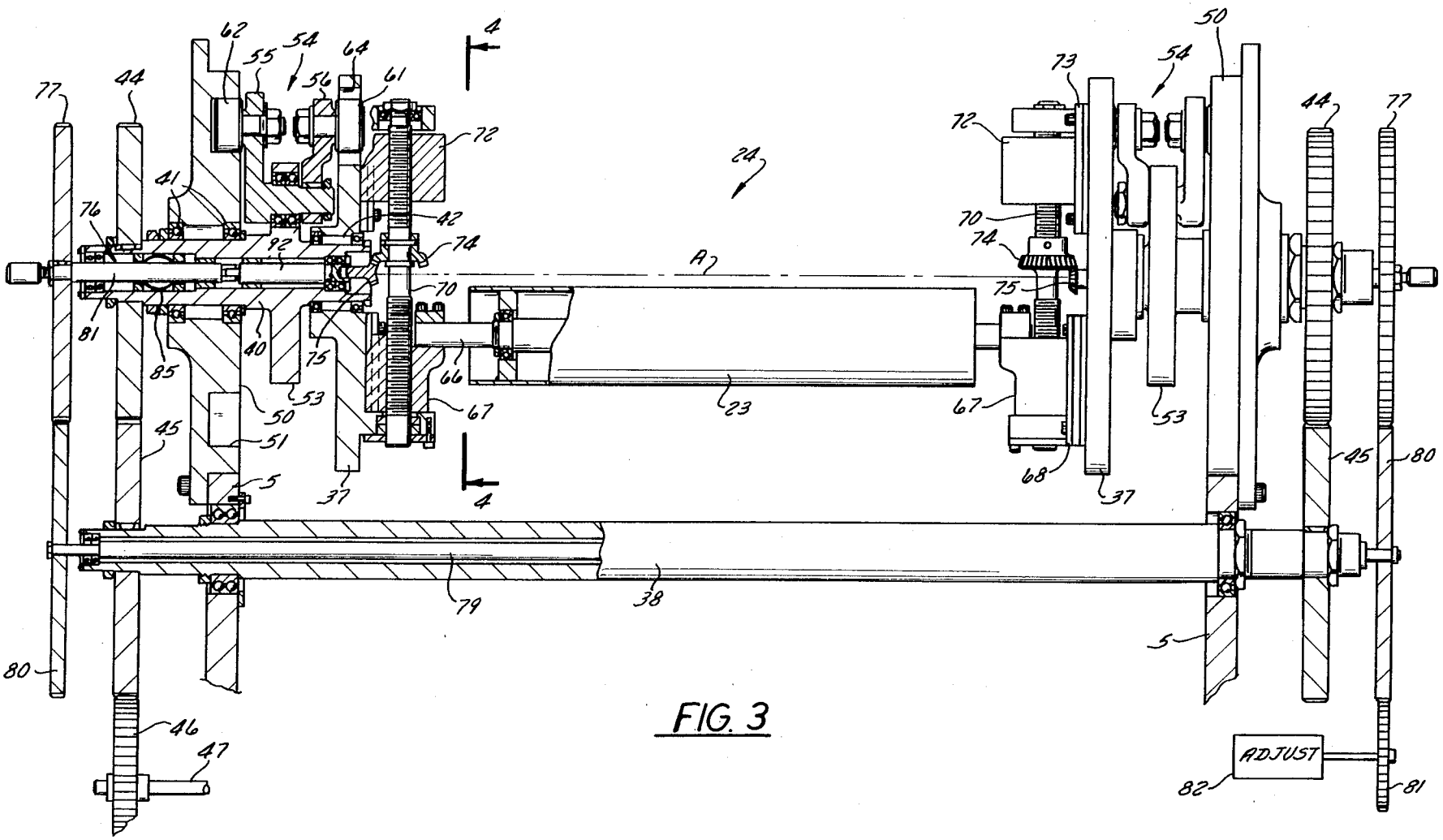
FIG. 3 is a view of the cyclically operated means adjacent to one end of the machine, partly in elevation as seen looking along the path of web travel, but with portions broken away and shown in longitudinal section, and with each control link shown shifted around its carrier element by 90° from its actual position.

A preferred embodiment of the invention, which is here illustrated, will be described with reference to the rear or upstream cyclically operating means 24, the front cyclically operating means 31 being identical to it. The control roller 23 is in this case carried for orbital motion by means of two carrier elements 37 (see FIG. 3), one at each end of the control roller, both rotatable about an axis A that is fixed with respect to the machine frame. The control roller 23 is rotatably mounted on the carrier elements 37, in bridging relation to them, with its axis parallel to said fixed axis A and spaced therefrom at an adjustably variable distance, to be carried in a circular orbit by unison rotation of the carrier elements. The two carrier elements 37 and the respective mechanisms that drive them are essentially mirror images of one another.

For each carrier element 37 there is a tubular shaft 40 which is rotatably supported in bearings 41 in the machine frame 5 and the axis of which coincides with the fixed axis A. Each carrier element 37 is mounted on an axially inner end of its tubular shaft 40, on bearings 42 that enable it to rotate freely relative to that shaft. The coaxial tubular shafts 40 are driven for unison rotation by means of a gear 44 coaxially fixed on the axially outer end of each. A synchronizing shaft 38 that extends parallel to the fixed axis A, outside the orbit of the control roller 23, has a gear 45 fixed to each of its ends, each meshing with one of the gears 44. One of the gears 44 or 45 meshes with a driving gear 46 on a rotatably driven line shaft 47 that also drives the delineating cylinder or cylinders 8 and is driven from a motor 48. Each tubular shaft 40 is thus driven for rotation in unison with the delineating cylinder. The carrier for the control roller 23, comprising the two carrier elements 37, must turn through one revolution for each revolution of the delineating cylinder, but its rotational speed must vary from part to part of its rotational cycle, so that it can effect the necessary accelerations, decelerations and rearward movement of the web stretch in the impression zone during the idle phase of the delineating cylinder cycle and can move that web stretch forward at the impression speed during the advancing phase.

The means for controlling the rotational speed of each carrier element 37 in every part of its cycle comprises a stationary cam plate 50, a driver 53 that is constrained to rotate with the tubular shaft 40, and a control link 54 that has a pair of arms 55 and 56. The cam plate 50 is fixed on the machine frame 5 in a position such that it can carry the bearings 41, which surround a medial portion of the tubular shaft 40. The cam plate 50 defines a cam track 51 which is contained in a plane normal to the fixed axis A and which extends around that axis, said cam track being in this case a groove in the cam plate face that is proximal to the carrier element 37. The driver 53, which is more or less disc-like, is fixed to the tubular shaft 40 between the cam plate 50 and the carrier element 37.

Figure 5:
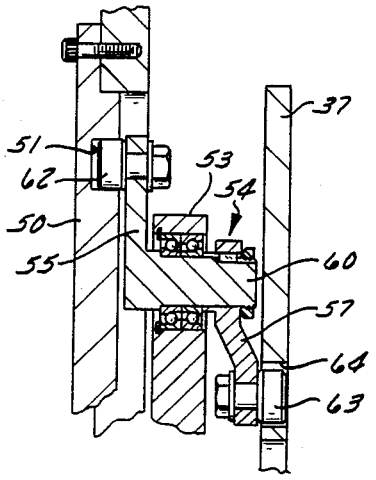
FIG. 5 is a fragmentary sectional view taken on the plane of the line 5—5 in FIG. 4, showing the control link its its connections to the driver, cam plate and carrier element.
Figure 4:
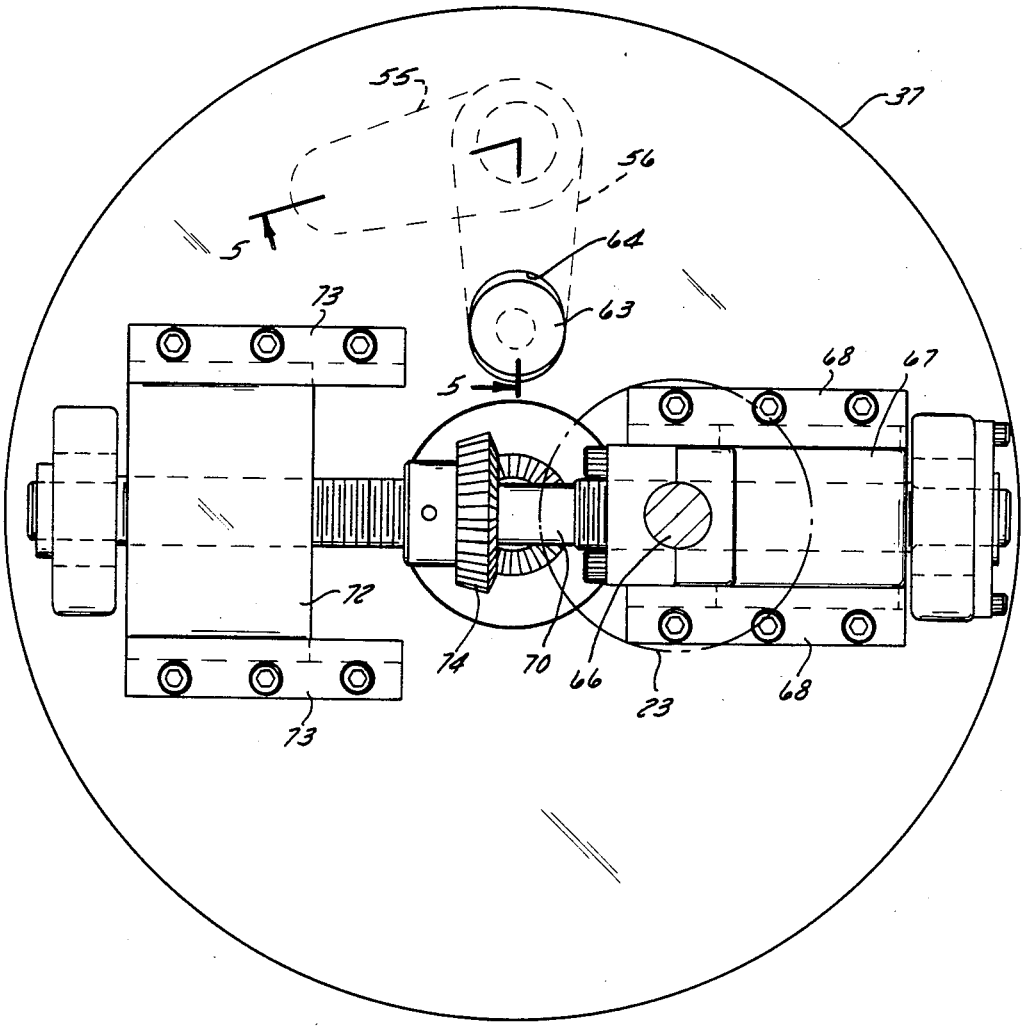
FIG. 4 is a detail view taken substantially on the plane of the line 4—4 in FIG. 3, but showing the control link in its true position relative to the carrier element.

One arm 56 of the control link 54 has connections at its opposite ends with the carrier element 37 and with the driver 53, respectively, whereby it is confined to swinging motion relative to one of them and to radial motion relative to the other of them, and whereby its swinging motion in opposite directions effects rotational accelerations and decelerations, respectively, of the carrier element 37 relative to the driver 53. The other arm 55 of the control link 54 provides a connection between the driver 53 and the cam track 51 whereby the control link is swung about its pivotal connection during rotation of the driver element 53 by differences in the distance between the fixed axis A and successive points along the cam track 51. As here shown, the two arms 55 and 56 of the control link 54 are fixed to opposite ends of a trunnion-like medial portion 60 thereof that is pivoted in the driver 53. The arms 55 and 56 are thus confined to swinging motion in unison relative to the driver 53 about a pivot axis which is spaced from and parallel to the fixed axis A about which the driver rotates with the tubular shaft 40. At its radially outer end the arm 55 of the control link carries a cam follower roller 62 which is engaged in the cam groove 51 in the cam plate. The other arm 56 has on its radially outer end a driving roller 63 that is engaged in a closely fitting but radially elongated slot 64 in the carrier element 37. Although the control link arms 55 and 56 lie substantially in planes normal to the fixed axis, as seen in FIG. 5, they are disposed at a substantially divergent angle to one another as viewed along that axis (see FIG. 4), and therefore the arm 55 extends more or less circumferentially relative to the driver 53, in trailing relation to it, whereas the arm 56 extends generally radially inwardly relative to the driver. (Note that FIG. 3, for purposes of explanation, shows the driving roller 63 and its slot 64 displaced 90° around the carrier element 37 from their actual positions, the true relationship being as shown in FIGS. 4 and 5.)

It will be apparent that as the driver 53 rotates with the tubular shaft 40, the cam follower 62, riding in the cam groove 51, swings the cam arm 55 of the control link radially outwardly in increasing-radius portions of the cam groove 51 and radially inwardly in decreasing-radius portions of that cam groove. As the cam arm 55 swings radially inwardly, the other arm 56 of the control link is swung, relative to the driver 53, in the direction of driver rotation, and it thus rotationally accelerates the carrier element 37. Conversely, as the cam follower 62 moves along an increasing-radius portion of the cam groove, the driving roller 63 is swung in the direction to rotationally decelerate the carrier element 37. The profile of the cam groove 51—that is, its distance from the fixed axis A at every point around it—thus determines the relative rotational speed of the control roller carrier in every part of its rotational cycle.

The decremental distance through which the impression stretch of the web is moved rearwardly in each delineating cylinder cycle depends upon the rotational speed of the feed rollers 21, 22, 33, 34 and the radius of the circular orbit in which each control roller 23, 30 is carried. For adjustment of that radius, a roller shaft 66 upon which the control roller 23 is freely rotatable has its ends supported in a pair of slide blocks 67, one for each carrier element 37, and each slide block is in turn confined to radially in and out motion relative to its carrier element 37 by a pair of gibs 68 that are fixed on the carrier element. For adjustment of the slide block 67 along the gibs 68 there is a threaded shaft 70 which extends transversely across the fixed axis A. The portion of the threaded shaft 70 that is at one side of the fixed axis is threaded in one direction and is received in a matingly threaded bore in the slide block 67. The portion of the threaded shaft at the other side of the fixed axis has an opposite thread and is received in a correspondingly threaded bore in a counterweight block 72 that is also confined to radially inward and outward adjusting motion relative to the carrier element 37 by means of further gibs 73 fixed on that element. The counterweight block 72 is of course adjusted radially inward and outward in unison with corresponding adjustments of the slide block 67.

For adjustingly rotating the threaded shaft 70, to adjust the radius of the control roller orbit, a bevel gear 74 is coaxially affixed to the threaded shaft near its middle, and it meshes with a bevel gear 75 that is fixed on the axially inner end of an adjusting shaft 76 which extends coaxially through the tubular shaft 40 and which has an adjusting gear 77 fixed to its outer end. The respective slide blocks 67 and counterweight blocks 72 on the two carrier elements 37 of the cyclically operating means are adjusted in unison, and thus in like amounts, by means of a transmission shaft 79 which extends through a coaxial bore in the synchronizing shaft 38 and which has a gear 80 coaxially fixed to each of its opposite ends, each said gear 80 being in meshing engagement with one of the adjusting gears 77. One of the gears 77 or 80 meshes with a gear 81 that is rotated by means of a suitable adjusting mechanism 82. The adjusting mechanism 82—which can be either manually or mechanically actuated—is not here illustrated because its form will be well understood by those skilled in this art, who will also understand that it is preferably calibrated in terms of repeat interval lengths.

Figure 6:
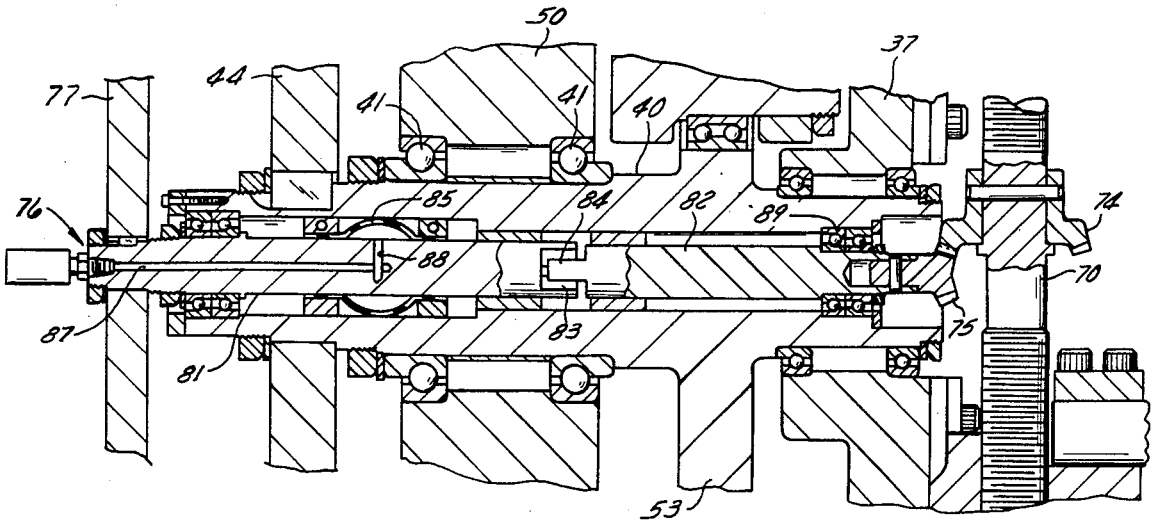
FIG. 6 is a fragmentary view generally like the left-hand portion of FIG. 3 but on an enlarged scale and showing details of the mechanism for adjusting the radius of the orbit of the control roller.

Adjustment of the radius of the orbits of the control rollers 23, 30 is accomplished with the machine shut down. When the machine is in operation, the bevel gear 75 on each adjusting shaft 76 must rotate with its adjacent carrier element 37, partaking of its rotational accelerations and decelerations, to prevent changes in the radius of the control roller orbit. To that end the adjusting shaft 76 is made in two endwise adjacent parts 81, 82 (see FIG. 6). The axially outer shaft part 81 has a wide axially opening slot 83 in its inner end, and the axially inner shaft part 82 has at its outer end a relatively narrow axially outwardly projecting tongue 84 which is loosely received in the slot 83 to permit the inner shaft part 82 to rotate through a fraction of a turn relative to the outer shaft part 81. Clamped to and surrounding the axially outer shaft part 81 intermediate its ends is an inflatable clamping bladder 85 which, when filled with pressurized air, engages the inner surface of the tubular shaft 40 and constrains the axially outer shaft part 81 to rotate with that tubular shaft. For charging air into the bladder 85 the outer shaft part 81 has a coaxial blind bore 87 that opens to its outer end and communicates with at least one radial bore 88 that opens into the bladder. The bladder 85 is maintained inflated while the machine is operating and is deflated to permit adjusting rotation of the adjusting shaft 76 relative to the tubular shaft 40. The axially inner part 82 of the adjusting shaft is supported in bearings 89 in the tubular shaft 40, and because of its low friction and small mass it can readily partake of the rotational accelerations and decelerations of the carrier element 37, as permitted by the loose tongue and slot connection 83, 84, which nevertheless constrains it to make one revolution for each revolution of the driver and to turn with the outer shaft part 81 during adjusting rotation thereof.

Differential Drive to Feed Rollers

As explained above, the feed rollers 21, 22 and 33, 34 rotate at a peripheral speed which is lower than that of the delineating cylinder 8 and which depends upon the repeat interval length for which the apparatus is adjusted. One feed roller 21, 33 of each pair is driven, the other feed roller 22, 34 of the pair can be a freely rotatable idler. The driven feed rollers 21, 33 are driven through a variable ratio differential drive 92 from the drive means 48 that rotates the delineating cylinder or cylinders. There can be a pair of identical variable ratio differential drives 92, one for each driven feed roller 21, 33, as here illustrated, or only one that drives both of those feed rollers in a manner that will be obvious.

Figure 7:
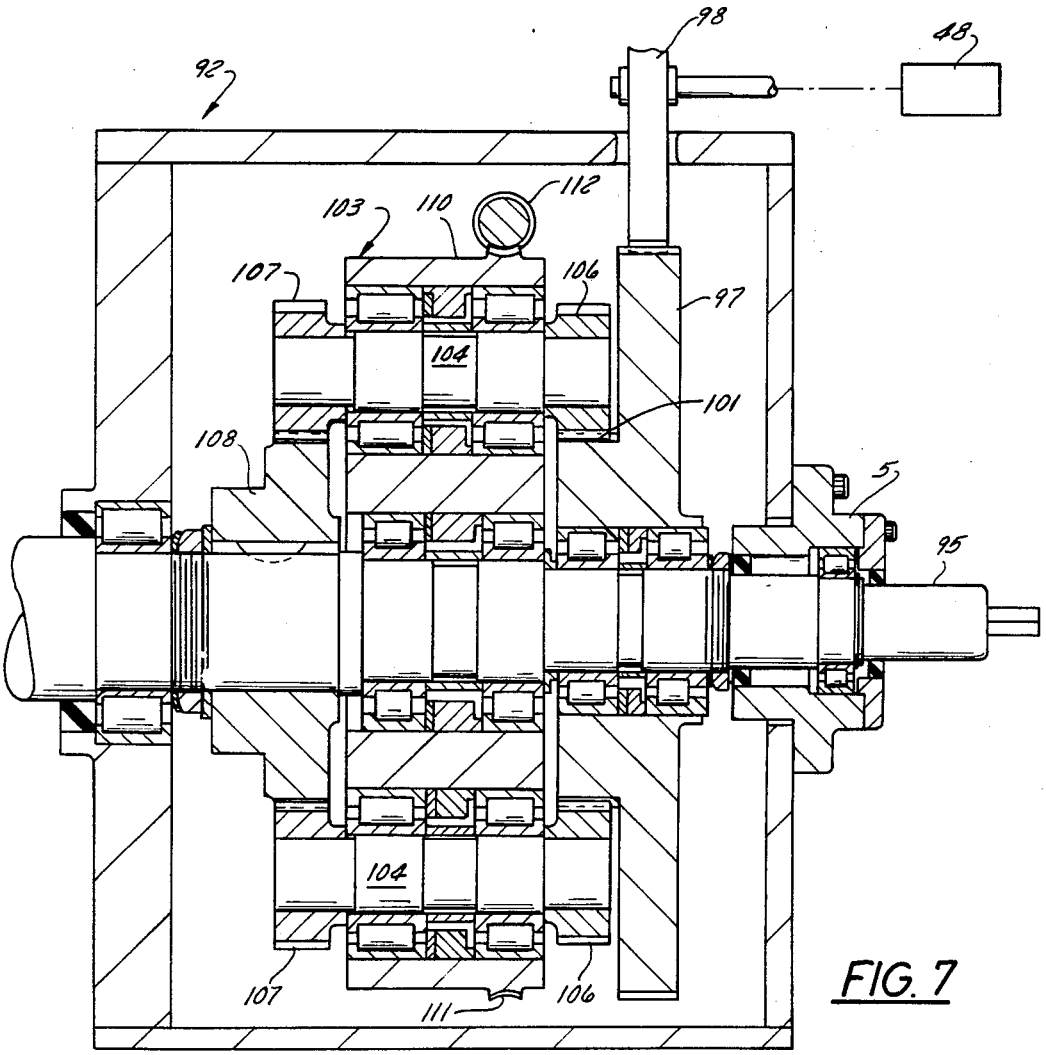
FIG. 7 is a view in longitudinal section of the variable ratio transmission through which the feed rollers are driven.

A preferred form of variable ratio differential drive 92, ilustrated in FIG. 7, is a variable ratio planetary gear mechanism that has two rotational inputs, one of them a driving input and the other a control input. This mechanism comprises an output shaft 95 which is journaled for rotation at a fixed location on the machine frame 5 and one end of which is drivingly connected with the driven feed roll 21, 33. Coaxially mounted on this output shaft 95 for rotation relative to it is a large diameter input gear 97 which meshes with a driving gear 98 that is rotated at a constant speed by the main drive motor 48. The driving gear 98 is also connected through a line shaft (not shown) or the like with the delineating cylinder 8. Coaxially fixed to the input gear 97 to rotate in unison with it about the output shaft 95 is a smaller-diameter driving sun gear 101. Also mounted on the output shaft 95 for rotation relative to it, axially adjacent to the driving sun gear 101, is a cage 103 in which a plurality of planet gear shafts 104 are rotatably journaled, all having their axes parallel to that of the output shaft and spaced at like distances therefrom. Fixed to one end of each planet gear shaft 104 is an input planet gear 106 which meshes with the driving sun gear 101. Fixed to the other end of each planet gear shaft 104 is a driven planet gear 107 which is of larger diameter than its coaxial input planet gear 106 and which meshes with a driven sun gear 108 that is coaxially fixed to the output shaft 95 for driving the same.

When the cage 103 is constrained against rotation relative to the fixed frame 5, the driven sun gear 108 is rotated faster than the driving sun gear 101. However, the cage 103 has a cylindrical peripheral wall 110 around which there are worm gear teeth 111 that mesh with a worm 112. A reversible, variable speed D.C. motor 114 drives the worm 112 and thus rotates the cage. The motor 114 provides, through the worm 112, a control input to the transmission whereby the cage 103 is rotated in the direction and at the rate appropriate to the desired repeat interval length. The D.C. motor 114 that rotates the cage is under a constant and relatively small load, and it is one that has a low inertia armature so that it can be readily adjusted to provide and accurately maintain a desired rotational speed ratio.

Tensioning Rollers

By means of the pairs of web tensioning rollers 25, 26 and 28, 29 that are respectively located adjacent to the front and rear ends of the impression zone the loop 19, 20 of web around each control roller 23, 30 is maintained under some degree of tension during the time that it is decreasing, and the web stretch in the impression zone is constrained to move at exactly the speed for which it is being controlled by the control roller 23 or 30 that is drawing an increasing loop. One tensioning roller 25, 28 of each pair is rotatably driven; the other 26, 29 is an idler which is bodily movable to and from a closed nip relationship with the driven one in synchronism with the delineating cylinder cycle. The driven roller 28 of the front pair rotates in the direction to draw web in the impresssion zone forwardly, while the driven rear tensioning roller 25 rotates in the opposite direction. The nip of the front tensioning roller pair 28, 29 is closed all through the advancing phase, and the nip of the rear tensioning roller pair 25, 26 is closed during at least that part of the idle phase in which the web in the impression zone is being moved rearward. Suitable mechanism for opening and closing the tensioning roller nips in synchronism with the delineating cycle is well known and therefore is not shown.

Each driven tensioning roller 25, 28 is constantly rotated in the appropriate direction and at a peripheral speed somewhat higher than the actual speed of movement of web stretch in the impression zone, so that each driven roller 25, 28 slips relative to the web when its nip is closed. Each of the driven tensioning rollers 25, 28 has a low friction peripheral surface which permits such slippage, so that the tensioning rollers merely maintain tension in the web stretch in the impression zone while the feed rollers 21, 22 and 33, 34 and the control rollers 23, 30 maintain their control over that part of the web.

From the foregoing description taken with the accompanying drawings, it will be apparent that this invention provides apparatus whereby uniform impressions are made at regular repeat intervals along a web of indefinite length, having provision for fast and easy stepless adjusting variation of repeat interval length. It will be further apparent that the apparatus of this invention, in addition to eliminating web wastage, affords production economies by minimizing down time needed for changing the repeat interval length and by reason of its arrangement which permits the delineating cylinder to be producing an impression during a substantially major portion of its rotational cycle.

What is claimed as the invention is:

1. Apparatus comprising means whereby a web of indeterminate length, drawn from a supply roll, is guided for lengthwise forward movement along a path through an impression zone that has front and rear ends which are spaced apart along said path and to a delivery zone, a rotatable delineating cylinder cooperating with a rotatable opposing cylinder to define a nip in said impression zone through which the web passes and at which the delineating cylinder produces uniform impressions on the web at uniform repeat intervals along it, said delineating cylinder having a cutout in its periphery to be out of contact with the web during an idle phase of each cycle of its rotation in which said cutout is juxtaposed to said opposing cylinder, the remainder of each said cycle being an advancing phase during which the delineating cylinder can produce an impression on the web, and drive means for rotating the delineating cylinder at a predetermined peripheral speed, said apparatus being characterized by:

A. a front pair and a rear pair of feed rollers, each said pair defining a nip through which the web passes to be fed forward by the pair, one feed roller of each said pair being rotatably driven from said drive means at a substantially steady rate such that the length of web fed forward by the pair during each said cycle is equal to the length of a repeat interval,
   (1) said rear pair being located along said path between the supply roll and the rear end of the impression zone, and
   (2) said front pair being located along said path between the front end of the impression zone and the delivery zone; and B. front and rear cyclically operating means,
   (1) each comprising
      (a) a control roller about which the web is looped,
      (b) a carrier by which the control roller is carried for cyclical bodily movement transverse to its length whereby the loop of web around the control roller is alternately increased and permitted to decrease, and
      (c) transmission means drivingly connecting said carrier with said drive means and whereby said carrier is actuated to carry the control roller through a cycle of its bodily movement during each said cycle of the delineating cylinder,
   (2) said front cyclically operating means being located along said path between said front end of the impression zone and said front pair of feed rollers, for constraining web in the impression zone to move forward at a speed equal to said peripheral speed all during each advancing phase and allowing the web in that zone to move rearward during each idle phase, and
   (3) said rear cyclically operating means being located along said path between said rear pair of feed rollers and the rear end of the impression zone, for allowing web in that zone to move forward all during each advancing phase and constraining web in that zone to move rearward through a predetermined distance during each idle phase.

2. The apparatus of claim 1,

C. wherein each said cyclically operating means has a fixed axis about which its carrier is rotatable and is further characterized by
   (1) control roller supporting means mounting its control roller on its carrier eccentrically to its fixed axis to be moved bodily in an orbit about that axis by rotation of the carrier, and
   (2) means for adjustingly shifting said control roller supporting means radially relative to the carrier, towards and from said fixed axis, to adjustably vary the radius of said orbit and thereby adjustably vary the distance through which web in the impression zone is moved rearward during each idle phase; and D. further characterized by a variable ratio driving transmission connected between said drive means and said one feed roller of each pair of feed rollers, for adjustably varying the length of web fed forward by the feed rollers during each cycle of rotation of the delineating cylinder.

3. The apparatus of claim 2 wherein the carrier of each said cyclically operating means is freely rotatable about its fixed axis and each said transmission means comprises:

(1) a driver axially adjacent to the carrier and confined to rotation coaxially therewith, said driver being connected with said drive means to be rotated thereby in unison with rotation of the delineating cylinder,
(2) fixed cam means axially adjacent to said driver defining a cam track substantially contained in a plane normal to said fixed axis and extending around the same, and
(3) a drive link having
   (a) a pivotal connection with said driver to be confined to swinging relative to the driver about a pivot axis which is spaced from and substantially parallel to said fixed axis,
   (b) a first arm extending outwardly from said pivotal connection and having at its outer end a cam follower engaged with said cam track to be swung about said pivot axis during rotation of the driver by differences in the distance between said fixed axis and successive points along the cam track, and
   (c) a second arm extending outwardly from said pivotal connection and rigid with said first arm to be swingable therewith, said second arm having at its outer end a connection with the carrier whereby the latter is constrained to rotate through one revolution for each revolution of the driver but is rotationally accelerated and decelerated relative to the driver by swinging of said arms.

4. Apparatus comprising means whereby a web of indeterminate length is guided for lengthwise forward movement along a path through an impression zone that has front and rear ends which are spaced apart along said path and to a delivery zone, a rotatable delineating cylinder cooperating with a rotatable opposing cylinder to define a nip in said impression zone through which the web passes and at which the delineating cylinder produces uniform impressions on the web at uniform length repeat intervals along it, said delineating cylinder having a cutout in its periphery to be out of contact with the web during an idle phase of each cycle of its rotation in which said cutout is juxtaposed to said opposing cylinder, the remainder of each said cycle being an advancing phase during which the delineating cylinder can produce an impression upon the web, and drive means for rotating the delineating cylinder at a predetermined peripheral speed, said apparatus being characterized by:

A. a pair of feed rollers that define a further nip through which the web passes, said feed rollers being located along said path between the front end of the impression zone and the delivery zone;
B. transmission means connecting said drive means with one of said feed rollers, said transmission means (1) having an adjustably variable ratio and
(2) providing for rotatably driving said one feed roller from said drive means at a substantially steady rate such that the length of web fed forward by the pair of feed rollers during each said cycle is equal to the length of one of said repeat intervals; and C. front and rear cyclically operating means
(1) each having a fixed axis and comprising
(a) a control roller about which the web is looped,
(b) a carrier element freely rotatable about said fixed axis,
(c) control roller supporting means mounting the control roller on said carrier element eccentrically to said fixed axis so that rotation of the carrier element moves the control roller bodily, transversely to its length, in an orbit whereby the loop of web around the control roller is alternately increased and permitted to decrease,
(d) means for adjustingly shifting said control roller supporting means radially relative to the carrier element, towards and from said fixed axis, to adjustably vary the radius of said orbit,
(e) a driver element axially adjacent to the carrier element and confined to rotation coaxially therewith, said driver element being connected with said drive means to be rotated thereby in unison with rotation of the delineating cylinder,
(f) fixed cam means axially adjacent to said driver element, having a cam track substantially contained in a plane normal to said fixed axis and extending around the same, and
(g) a drive link having
(i) a pivotal connection with one of said elements to be confined to swinging relative to the same about a pivot axis which is spaced from and substantially parallel to said fixed axis,
(ii) a first arm extending outwardly from said pivotal connection and having at its outer end a connection with the other of said elements that is confined to radial motion relative thereto so that swinging of said arm in opposite directions about said pivotal connection effects rotational acceleration and deceleration, respectively, of the carrier element relative to the driver element, and
(iii) a second arm extending outwardly from the connection between the driver element and the drive link and having at its outer end a cam follower engaged with said cam track whereby the drive link is swung about said pivotal connection during rotation of the driver element by differences in the distance between said fixed axis and successive points along the cam track,
(2) said front cyclically operating means being located along said path between the front end of the impression zone and said pair of feed rollers, and
(3) said rear cyclically operating means being located along said path in rearwardly spaced relation to the rear end of the impression zone.

5. The apparatus of claim 4, wherein a supply roll stand for supporting a supply roll from which web is drawn is spaced rearwardly along said path from said rear cyclically operating means, further characterized by:

D. a second pair of feed rollers defining a third nip through which the web passes, located along said path between said supply roll stand and said rear cyclically operating means, one of the feed rollers of said second pair being rotatably driven from said transmission means for rotation in unison with said one feed roller of the first mentioned pair.

6. The apparatus of claim 4, wherein said transmission means is a variable ratio planetary transmission comprising:
(1) a driving sun gear rotatably driven by said drive means,
(2) a driven sun gear coaxial with said driving sun gear and from which said one feed roller is rotatably driven,
(3) a cage coaxial with said sun gears and rotatable relative to both of them,
(4) a plurality of planet gears carried by said cage and confined to rotation relative thereto, each of said planet gears having meshing engagement with both of said sun gears, and
(5) a variable speed electric motor drivingly connected with said cage for rotating the same.

7. Apparatus comprising means whereby a web of indeterminate length is guided for lengthwise forward movement along a defined path, a rotatable delineating cylinder cooperating with a rotatable opposing cylinder to define a nip in said path through which the web passes and at which uniform impressions are produced on the web at uniform but adjustably variable repeat intervals along it, said delineating cylinder having a cutout in its periphery to be out of contact with the web through an idle phase in each cycle of its rotation during which said cutout is juxtaposed to said opposing cylinder and being cooperable with said opposing cylinder to produce an impression upon the web during an advancing phase in the remainder of each said cycle, drive means for rotating the delineating cylinder at a predetermined peripheral speed, at least one pair of feed rollers along said path whereby web is fed forward through a distance equal to the length of one of said repeat intervals during each said cycle, and front and rear cyclically operating means, respectively spaced forwardly and rearwardly along said path from said nip, cooperable with one another and with said feed rollers to advance web forwardly through said nip at a lengthwise speed equal to said peripheral speed through the advancing phase of each said cycle and whereby web is moved an adjustably variable distance rearwardly through said nip during each said idle phase, said apparatus being characterized by each said cyclically operating means comprising:

A. a control roller which extends transversely across said path and about which the web is looped;
B. a carrier element freely rotatable about a fixed axis;
C. control roller supporting means mounting the control roller on said carrier element eccentrically to said fixed axis so that rotation of the carrier element moves the control roller bodily, transversely to its length, in an orbit whereby the loop of web around the control roller is alternately increased and permitted to decrease;
D. means for adjustingly shifting the control roller supporting means radially relative to the carrier element, towards and from said fixed axis, to adjustably vary the radius of said orbit;
E. a driver element axially adjacent to the carrier element and confined to rotation coaxially therewith, said driver element being connected with said drive means to be rotated thereby in unison with rotation of the delineating cylinder;

F. fixed cam means axially adjacent to said driver element having a cam track substantially contained in a plane normal to said fixed axis and extending around the same; and G. a drive link having (1) a pivotal connection with one of said elements to be confined to swinging relative to the same about a pivot axis which is spaced from and substantially parallel to said fixed axis, (2) a first arm extending outwardly from said pivotal connection and having at its outer end a connection with the other of said elements that is confined to radial motion relative thereto so that swinging of said arm in opposite directions about said pivotal connection effects rotational acceleration and deceleration, respectively, of the carrier element relative to the driver element, and (3) a second arm extending outwardly from the connection between the driver element and the drive link and having at its outer end a cam follower engaged with said cam track whereby the drive link is swung about said pivotal connection during rotation of the driver element by differences in the distance between said fixed axis and successive points along the cam track.

8. The apparatus of claim 7, wherein there are front and rear pairs of feed rollers along said path, the front pair of feed rollers being spaced forwardly along said path from the front cyclically operating means and the rear pair of feed rollers being spaced rearwardly along said path from the rear cyclically operating means, further characterized by:

a variable ratio transmission through which one of the feed rollers of each said pair is driven from said drive means at a substantially steady rate which is adjustably variable and which is equal to the length of one of said repeat intervals per cycle of rotation of the delineating cylinder.

9. Apparatus comprising means whereby a web of indeterminate length is guided for lengthwise forward movement along a defined path, a rotatable delineating cylinder cooperating with a rotatable opposing cylinder to define a nip in said path through which the web passes and at which uniform impressions are produced on the web at repeat intervals along it that have uniform but adjustably variable lengths, said delineating cylinder having a cutout in its periphery to be out of contact with the web through an idle phase in each cycle of its rotation during which said cutout is juxtaposed to said opposing cylinder and being cooperable with said opposing cylinder to produce an impression upon the web during an advancing phase in the remainder of each said cycle, drive means for rotating the delineating cylinder at a predetermined peripheral speed, at least one pair of feed rollers along said path whereby web is fed forward through a distance equal to the length of one of said repeat intervals during each said cycle, and front and rear cyclically operating means, respectively spaced forwardly and rearwardly along said path from said nip, cooperable with one another and with said feed rollers to move web at said nip forwardly all during said advancing phase of each cycle and to move web at said nip rearwardly through an adjustably variable distance during each said idle phase, said apparatus being characterized by each said cyclically operating means comprising:

A. a control roller which extends transversely across said path and about which the web is looped;

B. a carrier element rotatable about a fixed axis;

C. control roller supporting means mounting the control roller on said carrier element eccentrically to said fixed axis so that rotation of the carrier element moves the control roller bodily, transversely to its length, in an orbit about said fixed axis whereby the loop of web about the control roller is alternately increased and permitted to decrease;

D. means for adjustingly shifting the control roller supporting means radially relative to the carrier elements towards and from said fixed axis, to adjustably vary the radius of said orbit and thus vary the distance through which web at said nip is moved rearward during each said idle phase; and E. driver means connected between said drive means and the carrier element for rotating the carrier element through a cycle of its revolution during each said cycle of the delineating cylinder and whereby the rotational speed of the carrier element is so varied from part to part of its said cycle that all during said advancing phase the web at said nip is maintained at a forward speed equal to the peripheral speed of the delineating cylinder and during said idle phase the web at said nip is smoothly decelerated and accelerated for its rearward movement and for resumption of forward movement.

10. The apparatus of claim 9 wherein said driver means comprises:

(1) stationary means defining a cam track substantially contained in a plane normal to said fixed axis and which extends around said fixed axis;

(2) a driver element between said stationary means and said carrier element, said driver element being (a) rotatable about said fixed axis and (b) connected with said drive means for rotation in unison with the delineating cylinder; and (3) a drive link having (a) a pivotal connection with one of said elements to be confined to swinging relative to the same about a pivot axis which is spaced from and substantially parallel to said fixed axis, (b) a first arm extending outwardly from said pivotal connection and having at its outer end a connection with the other of said elements that is confined to radial motion relative thereto so that swinging of said arm in opposite directions about said pivotal connection effects rotational acceleration and deceleration, respectively, of the carrier element relative to the driver element, and (c) a second arm extending outwardly from the connection between the driver element and the drive link and having at its outer end a cam follower engaged with said cam track whereby the drive link is swung about said pivotal connection during rotation of the driver element by differences in the distance between said fixed axis and successive points along the cam track.

11. The apparatus of claim 9, wherein there are front and rear pairs of feed rollers along said path, the front pair of feed rollers being spaced forwardly along said path from the front cyclically operating means and the rear pair of feed rollers being spaced rearwardly along said path from the rear cyclically operating means, further characterized by:

a variable ratio transmission through which one of the feed rollers of each said pair is driven from said drive means at a substantially steady rate which is adjustably variable and which is equal to the length of one of said repeat intervals per cycle of rotation of the delineating cylinder.

* * * * *